United States Patent [19]

Tholander

[11] Patent Number: 4,919,173

[45] Date of Patent: Apr. 24, 1990

[54] YARN STORAGE AND FEEDING DEVICE WITH RESILIENT BLOCKING BELT

[76] Inventor: Lars H. G. Tholander, Fagelstigen 7, 56100 Huskvarna, Sweden

[21] Appl. No.: 192,510

[22] PCT Filed: Aug. 19, 1987

[86] PCT No.: PCT/EP87/00467

§ 371 Date: May 6, 1988

§ 102(e) Date: May 6, 1988

[87] PCT Pub. No.: WO88/01315

PCT Pub. Date: Feb. 25, 1988

[30] Foreign Application Priority Data

Aug. 22, 1986 [DE] Fed. Rep. of Germany ..... 3628485

[51] Int. Cl.[5] ..... D03D 47/36

[52] U.S. Cl. ..... 139/452; 242/47.01

[58] Field of Search ..... 242/47.13, 47.01; 139/452

[56] References Cited

U.S. PATENT DOCUMENTS

| | | | |
|---|---|---|---|
| 4,574,847 | 3/1986 | Matsumoto | 139/452 |
| 4,627,474 | 12/1986 | Tholander | 139/452 |
| 4,744,394 | 5/1988 | Lincke | 139/452 |
| 4,784,191 | 11/1988 | Umemura et al. | 139/452 |
| 4,796,675 | 1/1989 | Tholander | 139/452 |

FOREIGN PATENT DOCUMENTS

| | | | |
|---|---|---|---|
| 1113858 | 5/1986 | Japan | 139/452 |
| 2223342 | 10/1987 | Japan | 139/452 |

*Primary Examiner*—Andrew M. Falik

*Attorney, Agent, or Firm*—Finnegan, Henderson, Farabow, Garrett and Dunner

[57] ABSTRACT

A yarn storage device is provided having a storage drum and a ring surrounding the storage drum. It also has a plurality of yarn stop devices each having a blocking element, which is adapted to be introduced into an annular gap between the storage drum and the ring upon actuation of the yarn stop device. A withdrawing device for the blocking element, which removes the blocking element from the gap after termination of the activation of the yarn stop device, comprises a belt of resilient material.

8 Claims, 3 Drawing Sheets

YARN STORAGE AND FEEDING DEVICE WITH RESILIENT BLOCKING BELT

BACKGROUND OF THE INVENTION

1. Field of the Invention The present invention relates to a yarn storage device.

2. Description of the Prior Art

Yarn storage devices, which are also referred to as feed wheel mechanisms, are generally known. With regard to the fundamental mode of construction and mode of functioning of such devices, reference is made to the applicant's published European Patent Application No. 83 109 818.1. The content of this European Patent Application is referred to as prior art to describe generally known yarn storage devices.

The known yarn storage devices are provided with actuation elements, which are supported in openings in the circumferential area of the storage drum. The yarn stop devices of the known yarn storage devices are electromagnets, which are arranged in the ring of the yarn storage devices and in the case of actuation of which the respective associated actuation element is removed from the opening in the circumferential area of the storage drum and is drawn into the gap between the ring and the storage drum, the yarn running spirally through said gap when it is drawn off the storage drum. As soon as the actuation element has been drawn into the gap to such an extent that its abuts on the ring, it will block the draw-off path for the yarn from the storage drum so that further unwinding of the yarn from the storage drum can be interrupted by activating the yarn stop device. The withdrawing device for the actuation element of the known yarn storage devices is defined by a permanent magnet, which is positioned in the storage drum at the end of the opening for guiding the actuation element. Although the known yarn storage device has proved to be extremely successful in many cases of practical use, there were some exceptional cases where after very long operating times of the yarn storage devices, in particular in unclean surroundings, malfunctions in the motion of the actuation element occurred; in the case of such malfunction, a return of the actuation element into the opening or a removal of said actuation element from the opening was sometimes impeded or prevented completely by dirt particles.

In comparison with this prior art, the present invention is based on the task of further developing such a yarn storage device in such a way that the operational reliability of said yarn storage device is further improved even in the case of unfavorable conditions existing in the surroundings.

SUMMARY OF THE INVENTION

The withdrawing device according to the invention, which is defined by a belt extending in the circumferential direction of the storage drum and consisting of a resilient material—said belt being in engagement with at least one yarn blocking element—abuts on the storage drum in the non-actuated condition of the respective yarn stop devices. Hence, dirt particles can only deposit on the belt surface positioned on the outer side in the radial direction of the storage drum, but on this side dirt cannot cause any deterioration in the operational reliability of the yarn blocking elements. The yarn blocking elements are preferably secured to the belt. This structural design of the yarn storage device according to the invention shows the advantage that guide means for the yarn blocking elements, which are required in the case of yarn storage devices according to the prior art, can be dispensed with.

The belt is preferably made of rubber, in particular of neoprene.

When the belt is arranged in a recess extending in the yarn circumferential direction of the storage drum, the yarn, when drawn off the storage drum, will only slide over the circumferential surface of said storage drum and the movement of said yarn will not be obstructed by the belt in the non-actuated condition of the yarn blocking elements.

Circumferentially extending beads between the recess and the circumferential surface of the storage drum, which project beyond said circumferential surface in the radial direction of said storage drum, define a slide guide surface for the yarn to the be drawn off, and this guarantees precise stopping of the yarn unwound from the storage drum in the case of an actuation of the yarn stop device.

A particularly simple mode of holding the yarn blocking elements is achieved by gluing said elements onto the belt.

The electromagnets, which constitute the actuating means for the yarn blocking elements together with the yarn blocking elements, are preferably arranged in the ring surrounding the storage drum. The ring surface extending opposite the actuation elements is lined with a hard, non-magnetic strip, preferably a steel strip, defining, on the one hand, an extremely flat stop surface for the yarn blocking elements, which resists also long periods of operation. On the other hand, said hard, non-magnetic strip will have the effect that the yarn blocking elements magnetically adhere to the electromagnet in the non-actuated condition of the yarn stop devices.

While the belt is provided with recesses for receiving therein the yarn blocking elements, said elements alternately can be connected to the belt by an elastic adhesive in a particularly reliable manner. On the other hand, the production of the belt provided with these yarn blocking elements will be facilitated due to the fact that, even by an unskilled worker, the belt can have attached thereto the yarn blocking elements only at the predetermined locations which will afterwards be positioned opposite the electromagnets.

The belt is preferably provided with projections towards its sides or towards the storage drum, said projections engaging depressions in the storage drum in the area of the recess so as to secure the angular position of the belt and the position in the circumferential direction of the belt relative to the storage drum. This structural design prevents the belt from circumferentially migrating on the storage drum during operation, which migration might endanger a reliable response of the yarn block elements to the magnetic fields produced by the electromagnets.

BRIEF DESCRIPTION OF THE DRAWINGS

In the following, a preferred embodiment of the yarn storage device according to the invention will be explained in detail while making reference to the drawings enclosed, in which.

DESCRIPTION OF THE PREFERRED EMBODIMENTS

Figure 1:
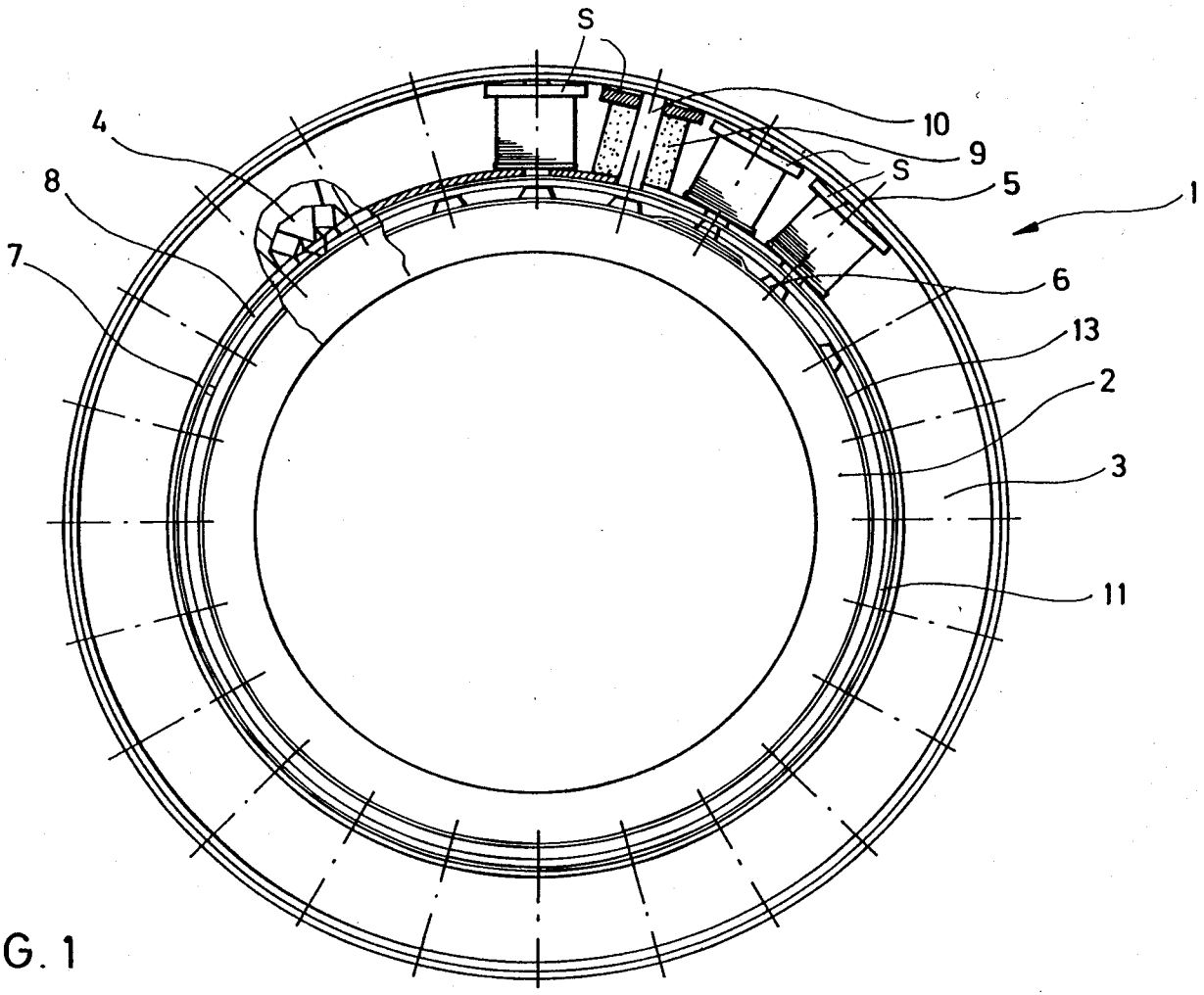
FIG. 1 shows a schematic representation of the cross-sectional representation of a draw-off end of a storage drum of a yarn storage device according to the present invention.

As can be seen in FIG. 1, a yarn storage device 1 consists of a storage drum 2 surrounded by a ring 3.

Figure 3:
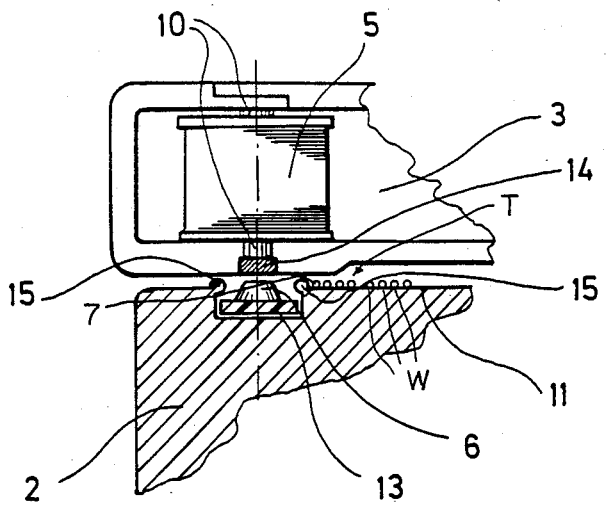
FIG. 3 shows an enlarged, detailed view along lines III—III of FIG. 2 of the yarn stop device of the yarn storage device of FIG. 1 in its non-actuated condition.
Figure 4:
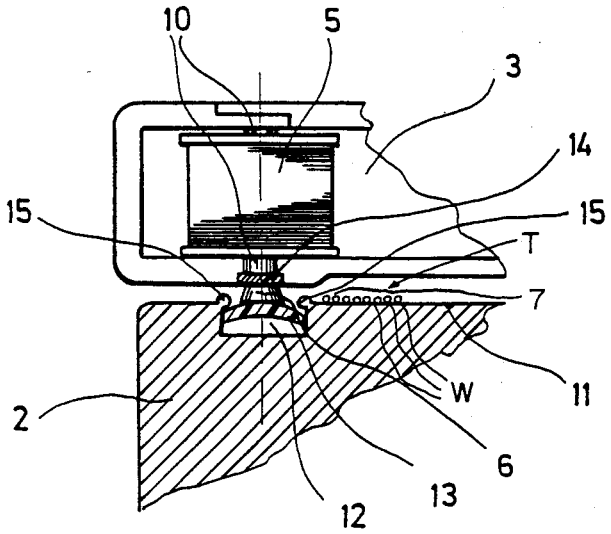
FIG. 4 is a view similar to FIG. 3 along lines IV—IV of FIG. 2 of the yarn stop device in its actuated condition.

The angular position of the storage drum 2 relative to the ring 3 is determined by a permanent magnet means, which is not shown. By means of a winding device (which is not shown) the storage drum 2 can have applied thereto a temporary yarn supply T, as shown in FIGS. 3 and 4, with the aid of which it is possible to balance intermittent yarn take-up of a subsequent yarn-consuming apparatus, such as a weaving loom or a knitting machine. The number of yarn windings W, as withdrawn from the storage drum 2 is determined by an opto-electronic detection means 4 consisting of a light-emitting diode and a phototransistor. Upon being withdrawn form the storage drum 2, the yarn 7 is drawn through a gap 8 positioned between the storage drum 2 and the ring 3. Several yarn stop devices each designated a 5 are provided in an equally spaced mode of arrangement in the circumferential direction of the storage drum and of the ring, respectively. Each yarn stop device 5 consists of an electromagnet 5, which is adapted to be actuated by an electric control signal, and of a yarn blocking element 6, which is positioned on the other side of the gap 8 when seen from the position of the electromagnet 5. Each electromagnet 5 consists of a coil 9 with a centrally arranged core 10, which is positioned in the ring 3 in the radial direction. In the area of its circumferential surface 11, the storage drum 2 is provided with a recess 12 having the shape of an annular groove and extending in the circumferential direction of the storage drum 2. Said annular groove 12 has provided therein a belt 13 which is made of neoprene. The yarn blocking elements 6 are glued onto the belt 13 at regular intervals corresponding to the mutual angular distances between the electromagnets 5.

The yarn blocking elements are made of a soft-magnetic material, preferably of iron. These elements have a frusto-conical shape. However, instead of the frusto-conical shape for each element 6, also other shapes are imaginable, in which connection it will, however, be advantageous when the element side facing the yarn 7 in the actuated condition of said element 6 is inclined relative to the radial direction in such a way that a tension in the yarn 7 results in a reaction force directed inwards in the radial direction of the storage drum 2.

Figure 2:
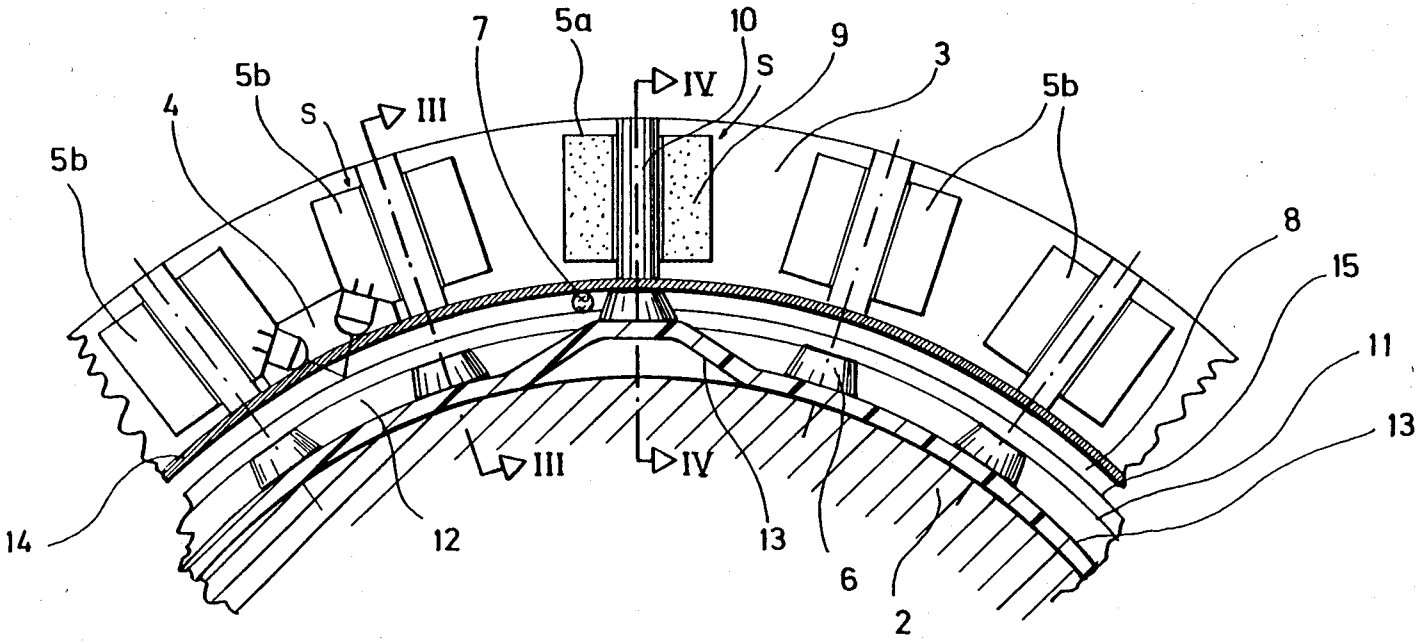
FIG. 2 shows an enlarged representation of details of the yarn storage device shown in FIG. 1.

An enlarged representation of details of part of the yarn storage device shown in FIG. 1 can be seen in FIG. 2. The components corresponding to the components which have already been described with regard to FIG. 1 are provided with corresponding reference numerals. Some yarn stop devices 5 are in the non-actuated condition. The electromagnets of these yarn stop devices are provided with reference numeral 5*b*. An electromagnet of a yarn stop device which is in its actuated condition is marked by reference numeral 5*a*. An actuation of the yarn stop devices 5 by supplying a control current to the electromagnet 5 thereof results in a magnetic field extending along the core 10 and drawing the yarn blocking element 6, which is disposed opposite said core 10, into the annular gap 8 so that said element abuts on the steel strip 14 lining the surface of the ring 3 extending opposite the storage drum 2. The spiral unwinding of the yarn 7 from the storage drum is thus interrupted.

In the area of the actuated yarn stop device having electromagnet 5*a*, the belt 13 is lifted off the storage drum 2 in the are of the annular groove 12 and is stretched and acts consequently as a pretensioned restoring spring for the actuation element 6.

The overall length of the resilient belt 13 is preferably selected such that it is slightly shorter than the circumference of the annular groove 12 of the storage drum 2. This results—also in the non-actuated position of the yarn stop devices 5—in a desired pretension of the yarn blocking element restoring device defined by the belt 13.

The ring 3 is provided with a cavity in which the electromagnet 5 is secured in position. In order to avoid short-circuiting of the magnetic field produced by the coil 9 of the electromagnet 5, the ring 3 is made of a non-magnetic material, such as a hard plastic material. Also the storage drum 2 is made of a non-magnetic material. Preferably, a magnetic path is provided, which extends from the radially outer end of the core 10 up to and into an area of the storage drum 2 which ends directly below the recess 12. It is thus possible to produce a particularly strong magnetic filed in the area of the yarn blocking element 6.

The recess or annular groove 12 merges with the circumferential surface 11 of the storage drum 2 via annular beads 15 projecting beyond the circumferential surface 11 of the storage drum 2 in the radial direction of said storage drum 2. The annular beads 15 also extend inwards relative to the annular groove 12. This guarantees that the yarn 7 is guided precisely when passing through the gap 8 between the ring 3 and the storage drum 2 in the area of the yarn blocking element 6.

The base of the annular groove 12 can be knurled so as to permit easy separation of the resilient belt 13 when a yarn stop device 5 is activated.

Deviating from the embodiment described, the yarn blocking elements may engage the belt by positive engagement instead of being glued onto said belt.

The material which may be used for the belt is, in addition to neoprene or rubber, any type of resilient material.

It is not absolutely necessary that the belt is a closed belt ring, but it may also consist of subcomponents extending only over sections of the circumference of the storage drum.

I claim:

1. A yarn storage device for a weaving loom comprising, a stationary yarn storage drum onto which a yarn supply can be wound and withdrawn from a yarn withdrawal end of said drum, a ring surrounding said yarn withdrawal end in spaced-apart relation thereto to form a gap between said ring and said drum, a belt of resilient material circumferentially mounted on said drum, a plurality of spaced-apart yarn blocking elements connected to and extending from said belt, actuating means upon selective actuation for moving radially from a yarn withdrawal position one of said blocking elements and a connected portion of said belt elastically to cause said one blocking element to extend toward said ring and into said gap to prevent yarn from being withdrawn from said drum, and said one blocking element and said elastically moved connected portion of said belt elastically returning to said yarn withdrawal position upon deactuation of said actuating means.

2. A device according to claim 1, characterized in that the belt is made of rubber.

3. A device according to claim 1, characterized in that the belt is arranged in a recess extending in the circumferential direction of the storage drum.

4. A device according to claim 3, characterized in that the circumferentially extending recess merges with a circumferential surface of the storage drum via circumferentially extending beads, and the beads project beyond the circumferential surface of the storage drum in a radial direction of said storage drum.

5. A device according to claim 1, characterized in that each yarn blocking element is glued onto the belt.

6. A device according to claim 1, characterized in that said means for actuating each of said yarn blocking elements includes an electromagnet arranged in the ring, and a ring surface extending opposite the blocking elements is lined with a strip of hard, non-magnetic material.

7. A device according to claim 1, characterized in that the belt is provided with recesses for receiving therein the yarn blocking elements secured thereto.

8. A device according to claim 1, characterized in that the belt is provided with projections engaging depressions in the recess so as to secure the position of the belt with regard to the storage drum in the circumferential direction of said storage drum.

* * * * *